US012800250B2

(12) United States Patent
Kras et al.

(10) Patent No.: US 12,800,250 B2
(45) Date of Patent: Nov. 17, 2026

(54) TRIGGER ASSEMBLY FOR A FIREARM

(71) Applicant: Sig Sauer, Inc., Newington, NH (US)

(72) Inventors: Krzysztof J. Kras, Fremont, NH (US); Luke E. Morenz, Dover, NH (US); Pascal Planchenault, Newmarket, NH (US); Grant Ridley, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 19/016,301

(22) Filed: Jan. 10, 2025

(65) Prior Publication Data

US 2025/0230997 A1 Jul. 17, 2025

Related U.S. Application Data

(60) Provisional application No. 63/620,348, filed on Jan. 12, 2024.

(51) Int. Cl.

| | |
|---|---|
| ***F41A 19/10*** | (2006.01) |
| ***F41A 3/66*** | (2006.01) |
| ***F41A 19/12*** | (2006.01) |

(52) U.S. Cl.

CPC ..... *F41A 19/10* (2013.01); *F41A 3/66* (2013.01); *F41A 19/12* (2013.01)

(58) Field of Classification Search

CPC ..... F41A 19/10; F41A 19/12; F41A 3/66

See application file for complete search history.

(56) References Cited

U.S. PATENT DOCUMENTS

| | | | | | |
|---|---|---|---|---|---|
| 4,117,761 | A | * | 10/1978 | Johnson | F41A 19/02 89/142 |
| 4,308,786 | A | * | 1/1982 | Hayashi | F41A 19/44 89/144 |
| 4,463,654 | A | | 8/1984 | Barnes et al. | |
| 4,677,781 | A | | 7/1987 | Lee | |
| 4,932,148 | A | | 6/1990 | Barrett | |
| 5,216,195 | A | * | 6/1993 | Tuma | F41A 19/48 89/146 |
| 5,280,683 | A | * | 1/1994 | Ping | F41A 19/44 42/69.03 |
| 5,718,074 | A | | 2/1998 | Keeney | |
| 6,101,918 | A | * | 8/2000 | Akins | F41A 19/03 89/129.01 |

(Continued)

OTHER PUBLICATIONS

FM Products, Ranch Rifle Lower 5397, available at https://store.fm-products.com/products/fm-products-rr-lwr-5397 (visited Jul. 3, 2025).

(Continued)

*Primary Examiner* — Michelle Clement

(74) *Attorney, Agent, or Firm* — Secant IP, PLLC

(57) ABSTRACT

A trigger assembly has a trigger rotatable about a trigger axis of rotation between a resting position and a pulled position, where the trigger has a trigger shoe and a trigger body. A sear has a catch surface, is located forward of the trigger, and is rotatable about a sear axis of rotation between an engaged position and a disengaged position. A trigger bar links the trigger to the sear such that moving the trigger from the resting position to the pulled position causes the sear to rotate from the engaged position to the disengaged position, or vice versa. The trigger assembly can be housed in a lower receiver compatible with an upper receiver of an autoloading firearm.

20 Claims, 5 Drawing Sheets

(56) References Cited

U.S. PATENT DOCUMENTS

| | | | | |
|---|---|---|---|---|
| 7,025,052 | B2 * | 4/2006 | Schavone | F41B 11/721 124/74 |
| 8,397,623 | B2 | 3/2013 | Herring | |
| 8,555,539 | B2 * | 10/2013 | Pflaumer | F41A 19/44 42/69.01 |
| 8,601,932 | B1 * | 12/2013 | Karfiol | F41A 19/12 42/69.02 |
| 8,714,145 | B2 * | 5/2014 | Maeda | F41B 11/62 124/76 |
| 8,944,041 | B2 | 2/2015 | Hu | |
| 9,347,725 | B2 | 5/2016 | Mcalister | |
| 9,441,899 | B2 * | 9/2016 | Micklethwaite | F41A 11/02 |
| 10,175,019 | B1 | 1/2019 | Al-Mutawa | |
| 10,337,813 | B2 | 7/2019 | Jonsson | |
| 10,563,951 | B1 * | 2/2020 | Sharps | F41C 23/20 |
| 10,739,107 | B2 | 8/2020 | Drake | |
| 11,346,622 | B2 | 5/2022 | Heuss et al. | |
| 12,104,867 | B2 * | 10/2024 | Geissele | F41A 19/44 |
| 2010/0236120 | A1 * | 9/2010 | Stone | F41A 19/45 42/69.01 |
| 2025/0230997 | A1 * | 7/2025 | Kras | F41A 3/66 |

OTHER PUBLICATIONS

Fightlite Industries, SCR Rifle, available at https://fightlite.com/rifles/scr (visited Jul. 3, 2025).

Uncle Jim YouTube Channel, "A Look at the Foxtrot Mike Ranch Lower" available at https://www.youtube.com/watch?v=UAJwZeAS-bA&t=525s (Nov. 15, 2023).

* cited by examiner

TRIGGER ASSEMBLY FOR A FIREARM

RELATED APPLICATIONS

This application claims the benefit under 35 U.S.C. § 119(e) of U.S. Provisional Patent Application No. 63/620,348 titled TRIGGER ASSEMBLY FOR A FIREARM, and filed on Jan. 12, 2024, the contents of which are incorporated herein by reference in its entirety.

TECHNICAL FIELD

The present disclosure relates generally to firearms and more particularly to a trigger assembly for a firearm.

BACKGROUND

Firearms include a variety of fire control mechanisms that include a trigger assembly. In some semiautomatic rifles, for example, when the user pulls rearward on the trigger shoe, the trigger pivots about its axis and thereby moves a sear to a disengaged position where it releases the cocked hammer to fire the gun. In some semiautomatic handguns, for example, a trigger is connected to a trigger bar that extends rearward along the side of the receiver. As the user pulls rearward on the trigger, the trigger bar shifts longitudinally—either forward or rearward—to move the sear to the disengaged position and release the cocked striker to fire the gun.

SUMMARY

The present disclosure is directed to a trigger assembly for a firearm, such as a rifle made according to the AR-15 or M16 platform and that utilizes a traditional fixed buttstock. In one example, a lower receiver is configured to assemble with an AR-15 type upper receiver and is configured for a fixed buttstock rather than a pistol grip. In order to meet ergonomic requirements of a fixed buttstock, the trigger is moved rearward compared to the trigger location of an existing AR-15-type lower receiver with pistol grip.

In one example embodiment, a trigger assembly includes a hammer, a sear, a trigger bar, and a trigger, where the trigger bar is pivotably coupled to both the sear and the trigger. The hammer, sear, and trigger all pivot around respective pivot axes. When the trigger is pulled, it rotates around its pivot axis, inducing movement to the pivotably coupled trigger bar, which in turn induces a rotation in the pivotably coupled sear. The sear rotates around its pivot axis until it has rotated sufficiently to sear off the hammer, allowing the hammer to rotate under spring tension to strike the firing pin. In some embodiments, the trigger assembly includes a spring or equivalent connected between the sear and trigger. The spring biases the sear and trigger towards each other, thereby eliminating any clearances that result from manufacturing tolerances.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
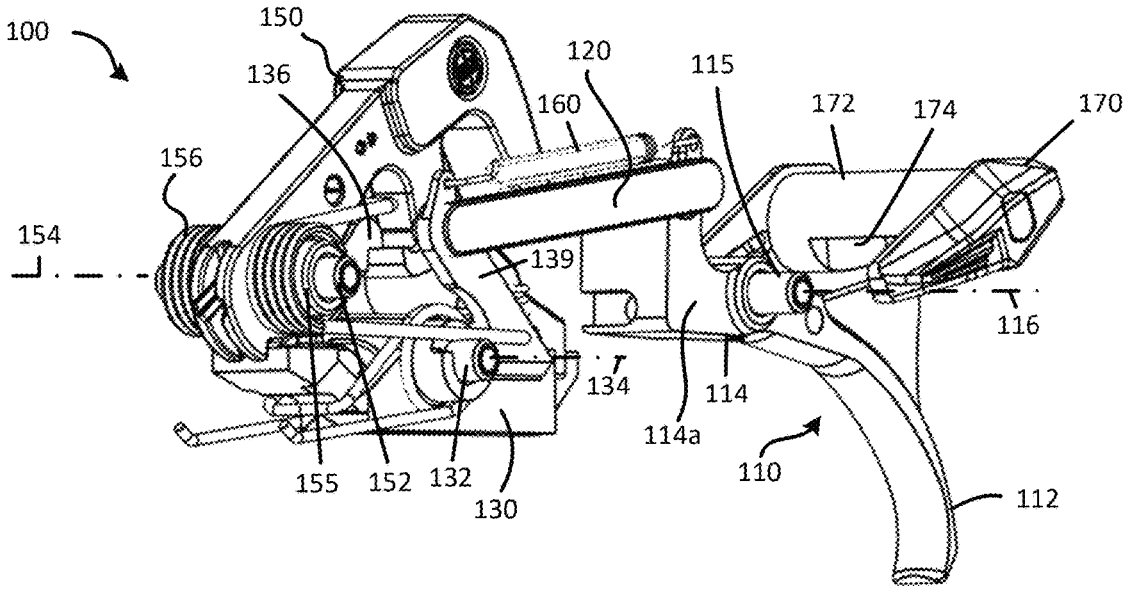
FIG. 1 illustrates a front and side perspective view of a trigger assembly, where the trigger is at rest, the sear is in an engaged position, and the hammer is in a cocked position, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a trigger assembly for a firearm. In one embodiment, the trigger assembly has a trigger rotatable about a trigger axis of rotation between a resting position and a pulled position, where the trigger has a trigger shoe and a trigger body. A sear has a catch surface, is located forward of the trigger, and is rotatable about a sear axis of rotation between an engaged position and a disengaged position. A trigger bar is connected between the trigger body and the sear. A hammer is located forward of the trigger and rotatable about a hammer axis of rotation between a cocked position and a fire position. Moving the trigger from the resting position to the pulled position causes the sear to rotate from the engaged position to the disengaged position via the trigger bar.

The trigger assembly can be housed in a lower receiver compatible with an upper receiver of an autoloading firearm. For example, the lower receiver operates without a buffer tube and is compatible with or is part of a firearm utilizing an upper receiver based on an AR-15 platform.

Overview

The M16 and AR-15-type rifles are a family of rifles based on the ArmaLite AR-15 platform made for the US military in the early 1960s. These rifles are characterized as a gas-operated, semiautomatic or fully automatic rifle with a lower receiver that is removably attached to an upper receiver. A stock is attached to the rear end of the lower receiver. In the M16, the stock is fixed and is used to shoulder the weapon. In AR-15 firearms, the stock has an adjustable length. In both the M16 and AR-15 variants, the firearm has a pistol grip that attaches to the bottom rear of the lower receiver, where the user grasps the pistol grip when firing the weapon.

Instead of using a pistol grip, it would be desirable to have an AR-15 type rifle with a fixed stock where the user fires the rifle while gripping the stock, similar to traditional bolt-action rifles. Thus, a need exists for improvements to the trigger assembly to accommodate firing the rifle while gripping a fixed stock. The present disclosure addresses this need and others by providing a trigger assembly configured for use with a receiver adapted to mate with an AR-15-type upper receiver, or other upper receiver based on the AR-15 platform, and having a fixed stock that can be gripped by the user when firing. Additionally, a receiver with the trigger assembly is provided. In one such embodiment, the receiver's fire control well is between the trigger guard and the magazine well, where the trigger is moved rearward compared to the trigger of AR-15 firearms so that it can be used with a fixed stock.

As used herein, terms referencing direction, such as upward, downward, vertical, horizontal, left, right, front, back, etc., are used for convenience to describe components of a firearm oriented in a traditional shooting position with the barrel extending horizontally in front of the user. Embodiments of the present disclosure are not limited by these directional references, and it is contemplated that a firearm, a trigger assembly, and related components of the present disclosure could be used in any orientation.

Example Embodiments

Figure 2:
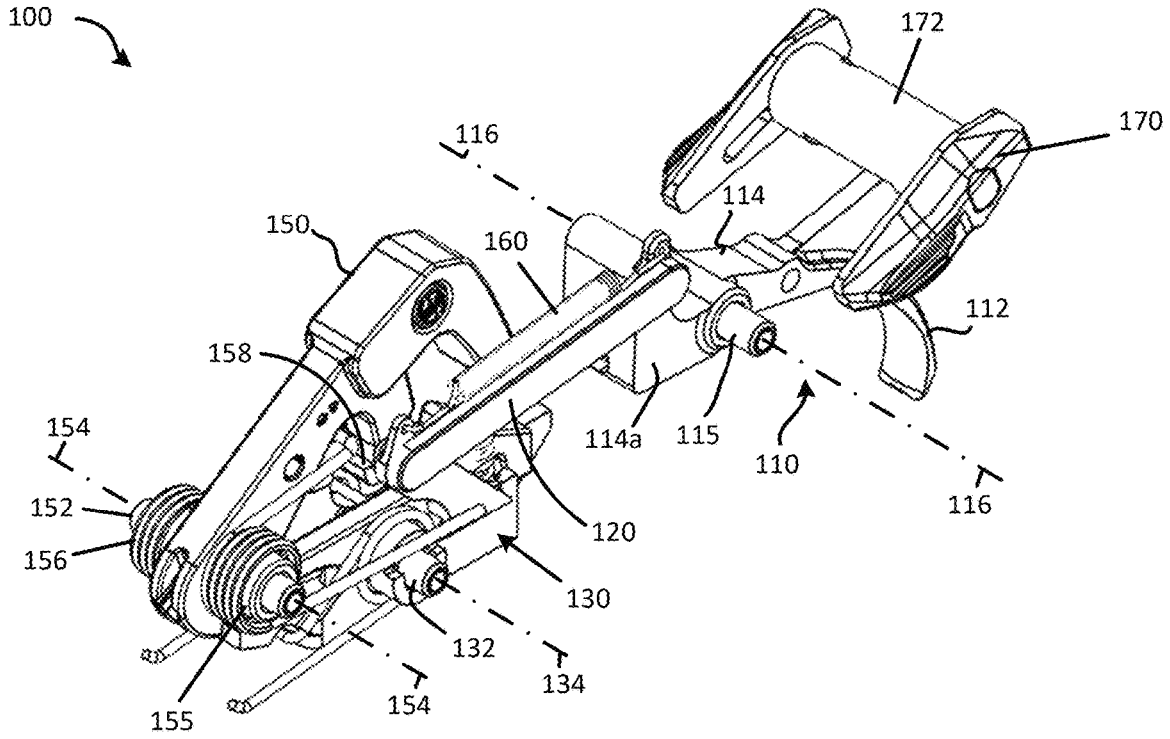
FIG. 2 illustrates a top, front, and side perspective view of the trigger assembly of FIG. 1.
Figure 3:
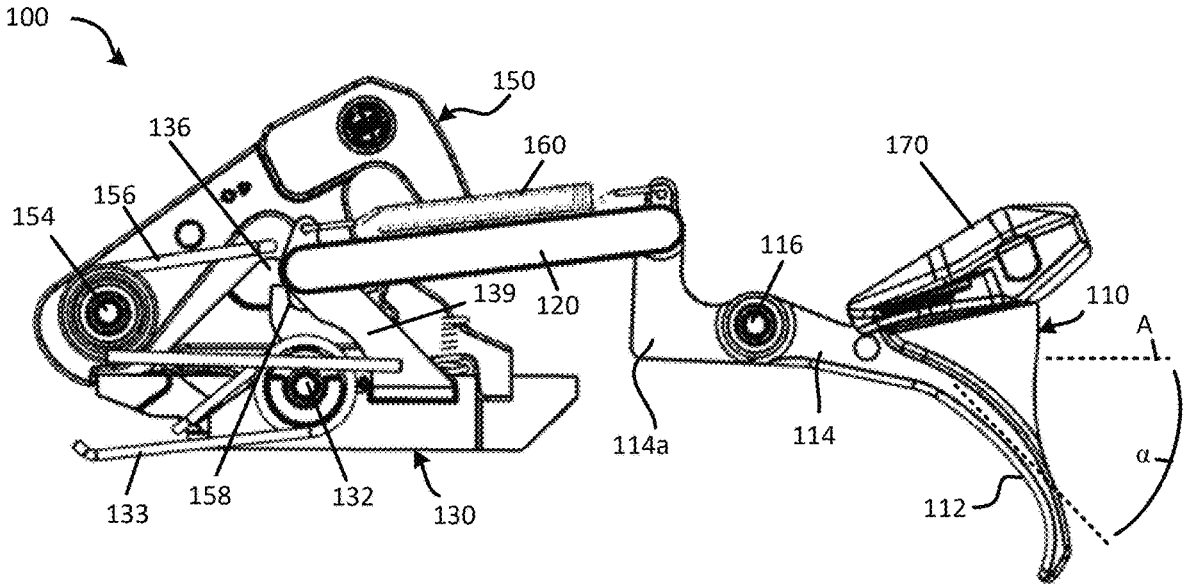
FIG. 3 illustrates a side view looking at a left side of the trigger assembly of FIG. 1.
Figure 4:
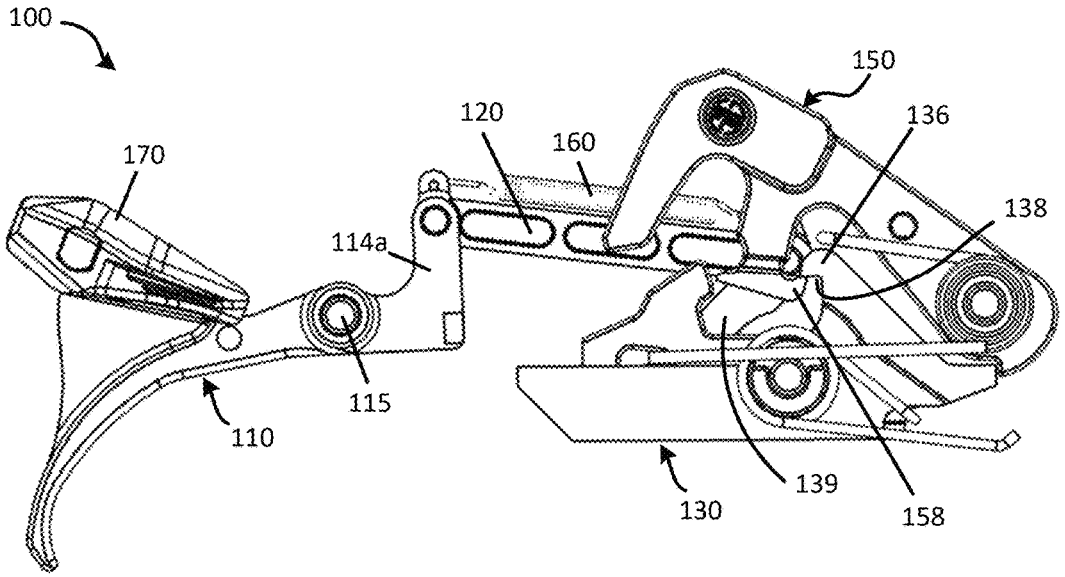
FIG. 4 illustrates a side view looking at a right side of the trigger assembly of FIG. 1.

FIGS. 1-2 illustrate a front perspective view and a front isometric view of a trigger assembly 100, in accordance with an embodiment of the present disclosure. FIG. 3 illustrates a side view looking at a left side of the trigger assembly 100 and FIG. 4 illustrates a side view looking at a right side of the trigger assembly 100. The trigger assembly 100 includes a trigger 110, a trigger bar 120, a sear 130, and a hammer 150. As shown in FIGS. 1-4, the trigger 110 is at rest, the sear 130 is in an engaged position, and the hammer 150 is in a cocked position. FIGS. 1-4 are discussed concurrently below.

Figure 8:
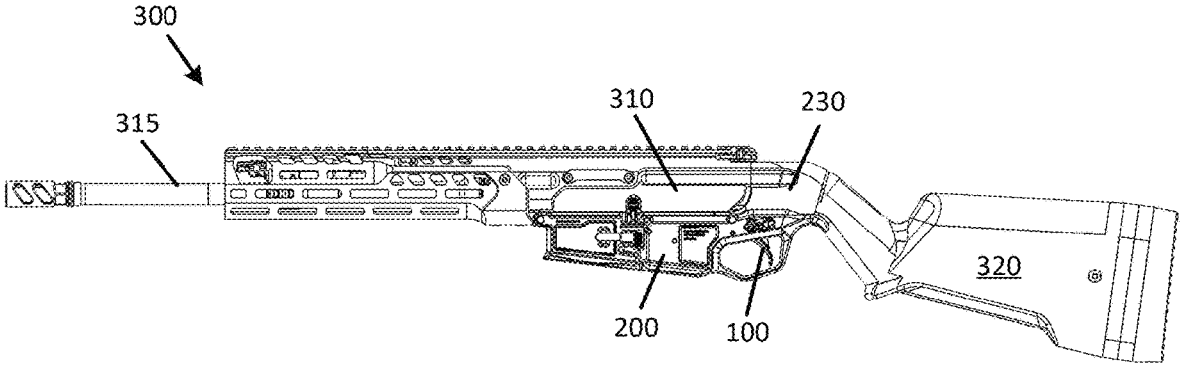
FIG. 8 illustrates a side view of a firearm incorporating the receiver of FIG. 7 and the trigger assembly of FIG. 1, in accordance with an embodiment of the present disclosure.

The trigger 110 has a trigger shoe 112 and a trigger body 114. The trigger 110 can rotate about a pin 115 extending through the trigger body 114 and extending along a trigger axis of rotation 116. As best shown in FIG. 3, the trigger shoe 112 extends rearward and downward from the trigger body 114. In some embodiments, the trigger shoe 112 defines an angle $\alpha$ in a range from 35° to 60°, such 40°-50° or about 45°, with respect to a horizontal axis A extending through the trigger body 114 when the firearm or receiver is oriented horizontally (e.g., as shown in FIG. 8). Note also that the trigger axis of rotation 116 is forward of the trigger shoe 112 and is positioned between the trigger shoe 112 and the distal end portion 114*a* of the trigger body 114. For example, the trigger axis of rotation 116 is located about midway between the trigger shoe 112 and the distal end portion 114*a* of the trigger body 114.

A trigger bar 120 connects to the distal end portion 114*a* of the trigger 114 and extends distally (forward) to connect with the sear 130. The sear 130 can rotate about a pin 132 extending along a sear axis of rotation 134 between an engaged position and a disengaged position. A sear spring 133 biases the sear 130 towards the engaged position, such as shown in FIGS. 1-4. The sear spring 133 can be, for example, a torsion spring installed about the sear axis of rotation 134.

The trigger bar 120 is arranged so that when the user pulls the trigger 110 (i.e., the user rotates the trigger shoe 112 rearward or rearward and upward), the trigger bar 120 moves forward to rotate the sear 130 about the pin 132. The sear 130 defines a catch 136 configured and arranged to engage a hammer 150 when the hammer 150 is in a cocked position. For example, the catch 136 can be configured as a hook, a ledge, or a protrusion, so that when the sear 130 is rotated by pulling the trigger 110, the sear 130 moves to a disengaged position in which the sear 130 disengages from the hammer 150. In this example, and as best seen in FIG. 4, the catch 136 has a downward-facing surface 138 that engages a corresponding upward-facing catch surface 158 on the hammer 150 when the hammer 150 is in the cocked position. Pulling the trigger 110 causes the sear 130 to rotate in a clockwise direction as viewed looking at the side of the trigger assembly 100 (e.g., as shown in FIG. 4). During this action, the downward-facing surface 138 of the sear 130 moves forward and down until it no longer contacts the catch surface 158 on the hammer 150. In other embodiments, the sear 130 can be configured to rotate in a counterclockwise direction as viewed looking at the right side of the trigger assembly 100.

The hammer 150 can rotate about a pin 152, which extends along a hammer axis of rotation 154, between cocked and firing positions. A hammer spring 156 biases the hammer 150 toward the firing position. The hammer spring 156 can be, for example, a torsion spring that is installed around a hub 155 centered on the hammer axis of rotation 154. In the cocked position, the catch surface 158 on the hammer 150 faces upward, and due to the spring bias, the catch surface 158 is urged to move upward against the downward-facing surface 138 of the catch 136 on the sear 130. Thus, rotating the sear 130 about the sear axis of rotation 134 moves the sear's catch 136 to a disengaged position where it disengages from the hammer's catch surface 158 and allows the hammer 150 to rotate forward to the firing position.

In some embodiments, the trigger assembly 100 includes a fire selector 170 operable between a safe position and one or more fire positions. In some embodiments, such as shown in FIGS. 1-2, the fire selector 170 includes a shaft 172 that includes a flat or recess 174. When the fire selector 170 is rotated, the shaft 172 rotates so that the shaft is in a blocking position or so that the recess 174 in a clearance position with respect to the trigger 110.

In some embodiments, the trigger assembly 100 includes a spring 160 connected between the sear 130 and the trigger 110. In this example, the spring 160 aligns with the trigger bar 120 and connects between the distal end portion 114*a* of the trigger body 114 and an arm 139 on the sear 130. The spring 160 is useful to take up clearance in the trigger bar 120 that may be needed to accommodate the trigger 110 and the sear 130 rotating about separate axes, and therefore changing the distance between the connection points of the trigger bar 120. When present, the spring 160 draws the trigger 110 towards the sear 130 to eliminate clearance in the trigger assembly 100. The spring 160 is not necessary for operation of the trigger assembly 100, but can be provided to enhance the user experience, in accordance with some embodiments.

Figure 5:
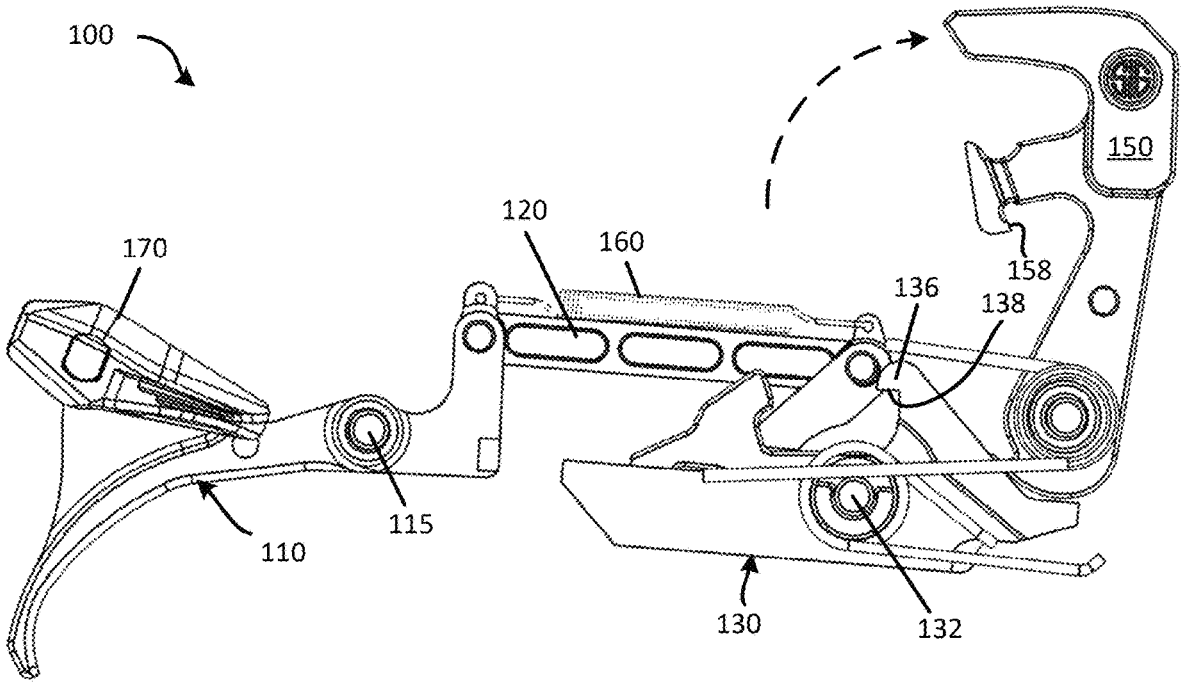
FIG. 5 illustrates a side view showing the trigger in a pulled position, the sear in a disengaged position, and the hammer in a firing position, in accordance with an embodiment of the present disclosure.

FIG. 5 illustrates a side view looking at the right side of the trigger assembly 100 and shows the trigger 110 in a pulled position, the sear 130 in a disengaged position, and the hammer 150 in a firing position, in accordance with an embodiment of the present disclosure. Relative to the positions shown in FIG. 4, the trigger has rotated clockwise about the trigger pin 115, causing the trigger bar 120 to shift forward to rotate the sear 130 about the sear pin 132. The catch 136 has disengaged from the catch surface 158 on the hammer 150, allowing the hammer 150 to rotate forward to the firing position.

Figure 6:
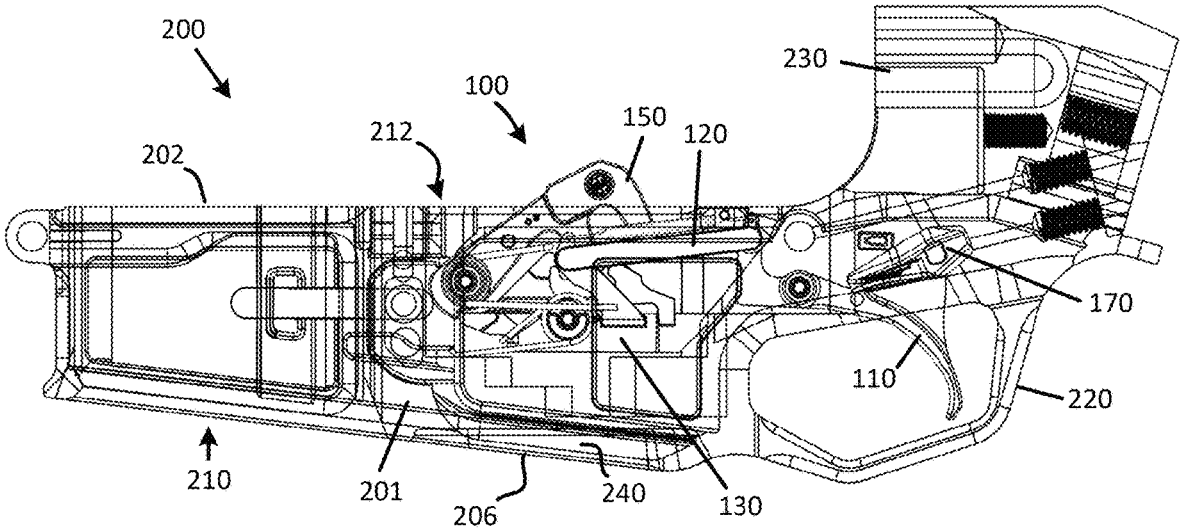
FIG. 6 illustrates a side view of a firearm receiver with the trigger assembly of FIG. 1, where the receiver is shown as transparent, in accordance with an embodiment of the present disclosure.
Figure 7:
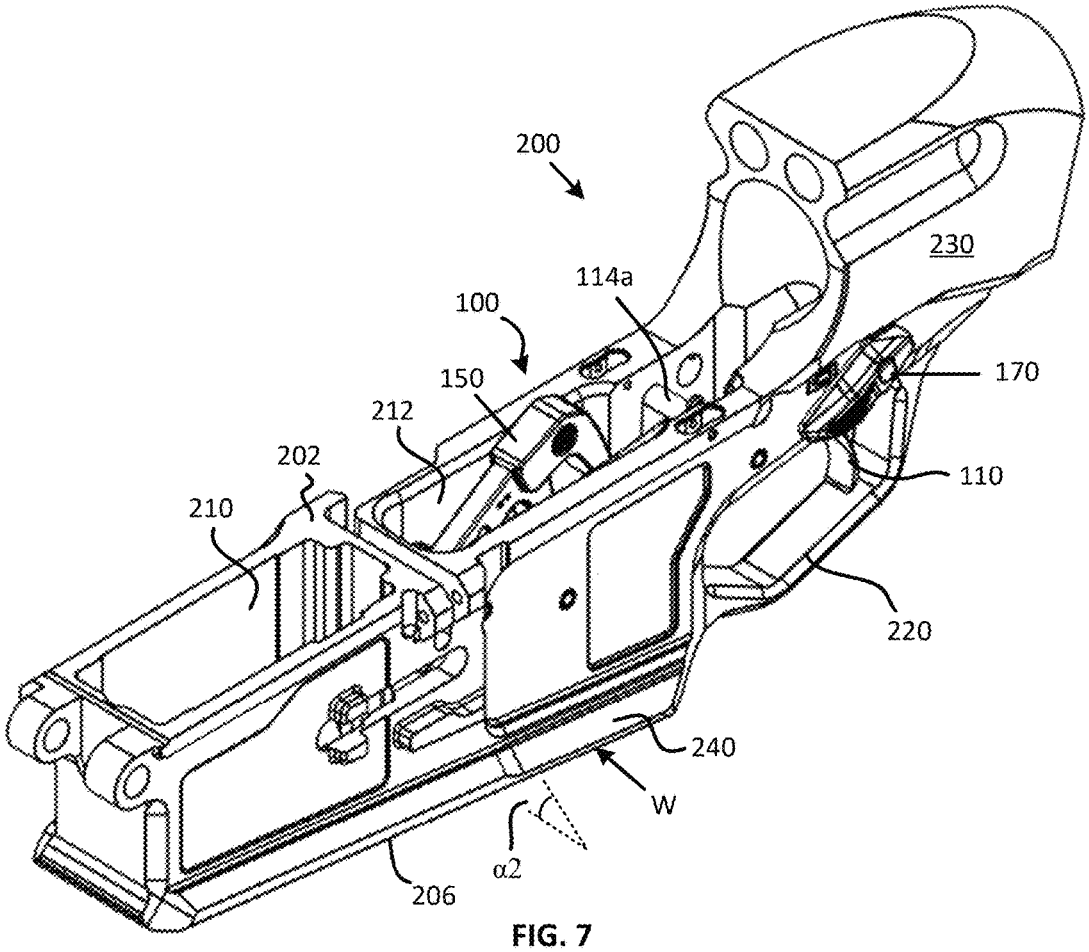
FIG. 7 illustrates a top, front, and side isometric view of the receiver and trigger assembly of FIG. 6, in accordance with an embodiment of the present disclosure.

FIG. 6 illustrates a side view of a firearm receiver 200 with the trigger assembly 100 of FIG. 1, in accordance with an embodiment of the present disclosure. FIG. 7 illustrates a top, front, and side isometric view of the receiver 200 and trigger assembly 100 of FIG. 6. In FIG. 6, the receiver 200 is shown as transparent to show components of the trigger assembly 100.

The receiver 200 is configured as a lower receiver that is adapted to mate with and assemble to an upper receiver of an AR-15-type firearm or equivalent. The receiver 200 has a body 201 that defines a magazine well 210 and a fire control well 212 that houses components of the fire control group, such as the hammer 150, sear 130, trigger bar 120, and associated springs and pins. A trigger guard 220 is attached to the body 201 rearward of the fire control well 212 and connects between the body 201 and the upper end portion 230. Note that the trigger guard 220 and trigger 110 are located rearward of the fire control well 212. The trigger 110 is operatively connected with the sear 130 via the trigger bar 120.

An upper end portion 230 of the receiver 200 is connected to the body 201 above the trigger guard 220. The upper end portion 230 extends above the top surface 202 of the body 201 and is configured to receive and/or engage with components of the recoil assembly (not shown), as will be appreciated. The fire selector 170 is mounted to the receiver 200 between the trigger 110 and the upper end portion 230.

In some embodiments, the receiver 200 defines sloped mounting surfaces 240 on opposite lateral and lower sides of the body 201 between the trigger guard 220 and the magazine well 210. Together the sloped mounting surfaces 240 mimic and function like dovetail mounting surfaces of a mounting plate that is configured to be received in the jaws of a corresponding clamp. In one embodiment, the sloped mounting surfaces 240 are configured according to dimensions of the Arca-Swiss system. For example, each sloped mounting surface 240 defines an angle $\alpha 2$ of $45° \pm 0.1$ with respect to a bottom surface 206 and the sloped mounting surfaces 240 define an overall width W of 1.5 inches as measured at the bottom of the sloped mounting surfaces 240. In other embodiments, the angle $\alpha 2$ can be in a range from 42-48°, in a range from 40-50°, in a range from 30-60°, or some other angle that is suitable for a corresponding clamp.

FIG. 8 illustrates a side view of a firearm 300 incorporating the receiver 200 of FIG. 6 and the trigger assembly 100 of FIG. 1, in accordance with an embodiment of the present disclosure. The firearm 300 includes an upper receiver 310 assembled to the lower receiver 200. The upper receiver 310 includes a barrel assembly 315. The lower receiver 200 houses components of the fire control assembly, including the trigger assembly 100. A stock 320 is attached to the upper end portion 230 of the receiver 200. In this example, the stock 320 is configured as a fixed stock similar to a fixed stock found on traditional bolt-action rifles.

In use, the receiver and trigger assembly advantageously enable an operator to grip the stock 320 and manipulate the trigger 110 while taking advantage of a firearm having a lower receiver that can be assembled with an upper receiver. A trigger assembly as disclosed herein can be provided as a parts kit, as part of a firearm lower receiver, or as part of a complete firearm. Numerous variations and embodiments will be apparent in light of the present disclosure.

Further Example Embodiments

The following examples pertain to further embodiments, from which numerous permutations and configurations will be apparent.

Example 1 is a trigger assembly that includes a trigger rotatable about a trigger axis of rotation between a resting position and a pulled position, where the trigger has a trigger shoe and a trigger body. A sear has a catch surface, and the sear is located forward of the trigger and rotatable about a sear axis of rotation between an engaged position and a disengaged position. A trigger bar links the trigger body to the sear. Moving the trigger from the resting position to the pulled position causes the sear to move from the engaged position to the disengaged position, and moving the trigger from the pulled position to the resting position causes the sear to move from the disengaged position to the engaged position.

Example 2 includes the trigger assembly of Example 1, where the trigger shoe extends downward and rearward from the trigger body.

Example 3 includes the trigger assembly of any one of Examples 1-2, where the hammer is positioned above the sear.

Example 4 includes the trigger assembly of any one of Examples 1-3 and further includes a firearm lower receiver defining a magazine well, a fire control well, a trigger guard, and an upper end portion, where the fire control well is positioned longitudinally between the magazine well and the trigger guard. A stock is attached to the upper end portion of the receiver. The fire control well houses at least the hammer and the sear. The trigger shoe is positioned below the upper end portion of the receiver.

Example 5 includes the trigger assembly of Example 4, where the firearm lower receiver is compatible with an upper receiver of an AR-15-type firearm.

Example 6 includes the trigger assembly of any one of Examples 1-5 and includes a spring connected between the trigger body and the sear.

Example 7 includes the trigger assembly of Example 6, where the spring extends along the trigger bar.

Example 8 is an autoloading firearm comprising the trigger assembly of any one of Examples 1-7, a hammer located forward of the trigger and rotatable about a hammer axis of rotation between a cocked position and a fire position, a lower receiver housing the trigger assembly, and an upper receiver configured to be removably mounted along a top of the lower receiver.

Example 9 includes the autoloading firearm of Example 8, where the lower receiver defines a magazine well, a fire control well, a trigger guard, and an upper end portion, and where the fire control well is positioned longitudinally between the magazine well and the trigger guard. The autoloading firearm has a stock attached to the upper end portion of the receiver. The fire control well houses at least the hammer and the sear, and the trigger shoe is positioned below the upper end portion of the receiver.

Example 10 includes the autoloading firearm of any one of Examples 8 or 9, where the lower receiver is compatible with an upper receiver of an AR-15-type platform.

Example 11 is a trigger assembly comprising a trigger configured to be rotatable about a trigger axis of rotation between a resting position and a pulled position, where the trigger has a trigger shoe and a trigger body. A sear has a catch surface and is configured to be located forward of the trigger and rotatable about a sear axis of rotation between an engaged position and a disengaged position. A trigger bar is configured to be connected between the trigger body and the sear. A hammer is configured to be located forward of the trigger and rotatable about a hammer axis of rotation between a cocked position and a fire position. In an assembled condition, when the hammer is in the cocked position and the sear is in the engaged position, the sear is configured to engage the hammer to retain the sear in the cocked position until the trigger is moved to the pulled position. In the assembled condition, moving the trigger from the resting position to the pulled position causes the sear to rotate from the engaged position to the disengaged position via the trigger bar, and moving the trigger from the pulled position to the resting position causes the sear to rotate from the disengaged position to the engaged position via the trigger bar.

Example 12 includes the trigger assembly of Example 11, where in the assembled condition the trigger shoe extends downward and rearward from the trigger body.

Example 13 includes the trigger assembly of any one of Examples 11-12, where in the assembled condition the hammer is positioned above the sear.

Example 14 includes the trigger assembly of any one of Examples 11-13 and includes a firearm lower receiver defining a magazine well, a fire control well, a trigger guard, and an upper end portion, wherein the fire control well is between the magazine well and the trigger guard. A fixed stock is attached to the upper end portion of the receiver, where the fire control well is configured to houses at least the hammer and the sear. When assembled with the firearm lower receiver, the trigger shoe is positioned below the upper end portion of the receiver.

Example 15 includes the trigger assembly of Example 14, where the firearm lower receiver is compatible with an upper receiver of an AR-15-type firearm.

Example 16 includes the trigger assembly of any one of Examples 11-15 and includes a spring configured to be connected between the trigger body and the sear.

Example 17 includes the trigger assembly of Example 16, where in the assembled condition the spring extends along the trigger bar.

Example 18 is a firearm receiver including the trigger assembly of any one of Examples 1-7.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A trigger assembly comprising:

a trigger rotatable about a trigger axis of rotation between a resting position and a pulled position, the trigger having a trigger shoe and a trigger body;

a sear having a catch surface, the sear located forward of the trigger and rotatable about a sear axis of rotation between an engaged position and a disengaged position; and a trigger bar pivotably connected to the trigger body and pivotably connected to the sear, wherein the trigger bar links the trigger body to the sear;

wherein moving the trigger from the resting position to the pulled position causes the sear to move from the engaged position to the disengaged position, and moving the trigger from the pulled position to the resting position causes the sear to move from the disengaged position to the engaged position.

2. The trigger assembly of claim 1, wherein the trigger shoe extends downward and rearward from the trigger body.

3. The trigger assembly of claim 1, comprising: a hammer positioned above the sear.

4. The trigger assembly of claim 3, further comprising:

a firearm lower receiver defining a magazine well, a fire control well, a trigger guard, and an upper end portion, wherein the fire control well is positioned longitudinally between the magazine well and the trigger guard;

a stock attached to the upper end portion of the receiver;

wherein the fire control well houses at least the hammer and the sear; and wherein the trigger shoe is positioned below the upper end portion of the receiver.

5. The trigger assembly of claim 1, further comprising:

a firearm lower receiver defining a magazine well, a fire control well, a trigger guard, and an upper end portion, wherein the fire control well is positioned longitudinally between the magazine well and the trigger guard;

a stock attached to the upper end portion of the receiver;

wherein the fire control well houses at least the hammer and the sear; and wherein the trigger shoe is positioned below the upper end portion of the receiver.

6. The trigger assembly of claim 5, wherein the firearm lower receiver is compatible with an upper receiver of an autoloading rifle.

7. The trigger assembly of claim 1, further comprising a spring connected between the trigger body and the sear.

8. The trigger assembly of claim 7, wherein the spring extends along the trigger bar.

9. An autoloading firearm comprising:

the trigger assembly of claim 1;

a hammer located forward of the trigger and rotatable about a hammer axis of rotation between a cocked position and a fire position;

a lower receiver housing the trigger assembly; and an upper receiver configured to be removably mounted along a top of the lower receiver.

10. The autoloading firearm of claim 9, wherein:

the lower receiver defines a magazine well, a fire control well, a trigger guard, and an upper end portion, wherein the fire control well is positioned longitudinally between the magazine well and the trigger guard;

a stock is attached to the upper end portion of the receiver;

the fire control well houses at least the hammer and the sear; and the trigger shoe is positioned below the upper end portion of the receiver.

11. The autoloading firearm of claim 10, wherein the lower receiver is compatible with an upper receiver of a semi-automatic rifle.

12. A trigger assembly comprising:

a trigger configured to be rotatable about a trigger axis of rotation between a resting position and a pulled position, the trigger having a trigger shoe and a trigger body;

a sear having a catch surface, the sear configured to be located forward of the trigger and rotatable about a sear axis of rotation between an engaged position and a disengaged position;

a trigger bar configured to be connected to the trigger body and to the sear, thereby linking the trigger to the sear; and a hammer configured to be located forward of the trigger and rotatable about a hammer axis of rotation between a cocked position and a fire position;

wherein, in an assembled condition, when the hammer is in the cocked position and the sear is in the engaged position, the sear is configured to engage the hammer to retain the sear in the cocked position until the trigger is moved to the pulled position;

wherein, in the assembled condition, moving the trigger from the resting position to the pulled position causes the sear to rotate from the engaged position to the disengaged position via the trigger bar, and moving the trigger from the pulled position to the resting position causes the sear to rotate from the disengaged position to the engaged position via the trigger bar.

13. The trigger assembly of claim 12, wherein in the assembled condition the trigger shoe extends downward and rearward from the trigger body.

14. The trigger assembly of claim 13, wherein in the assembled condition the hammer is positioned above the sear.

15. The trigger assembly of claim 14, further comprising:

a firearm lower receiver defining a magazine well, a fire control well, a trigger guard, and an upper end portion, wherein the fire control well is between the magazine well and the trigger guard; and a fixed stock attached to the upper end portion of the receiver;

wherein the fire control well is configured to houses at least the hammer and the sear; and wherein, when assembled with the firearm lower receiver, the trigger shoe is positioned below the upper end portion of the receiver.

16. The trigger assembly of claim 15, wherein the firearm lower receiver is compatible with an upper receiver of an autoloading firearm.

17. The trigger assembly of claim 12, further comprising a spring configured to be connected between the trigger body and the sear.

18. The trigger assembly of claim 17, wherein in the assembled condition the spring extends along the trigger bar.

19. A firearm receiver comprising the trigger assembly of claim 1.

20. The firearm of claim 19, comprising:

a receiver housing the trigger assembly; and a fixed stock attached to the receiver.

* * * * *